US008440897B1

(12) United States Patent
Baxter

(10) Patent No.: US 8,440,897 B1
(45) Date of Patent: May 14, 2013

(54) GUITAR WITH HIGH SPEED, CLOSED-LOOP TENSION CONTROL

(75) Inventor: Keith M. Baxter, Brookfield, WI (US)

(73) Assignee: Keith M. Baxter, Brookfield, WI (US)

( * ) Notice: Subject to any disclaimer, the term of this patent is extended or adjusted under 35 U.S.C. 154(b) by 193 days.

(21) Appl. No.: 12/905,371

(22) Filed: Oct. 15, 2010

Related U.S. Application Data

(60) Provisional application No. 61/253,268, filed on Oct. 20, 2009.

(51) Int. Cl.
*G10G 7/02* (2006.01)

(52) U.S. Cl.
USPC ..... 84/454; 84/313; 84/455; 84/723; 84/727

(58) Field of Classification Search ..... None
See application file for complete search history.

(56) References Cited

U.S. PATENT DOCUMENTS

| | | | | |
|---|---|---|---|---|
| 4,375,180 | A * | 3/1983 | Scholz | 84/454 |
| 5,038,657 | A * | 8/1991 | Busley | 84/455 |
| 5,390,579 | A * | 2/1995 | Burgon | 84/454 |
| 5,528,970 | A * | 6/1996 | Zacaroli | 84/312 R |
| 6,875,911 | B2 * | 4/2005 | Schryer | 84/313 |
| 7,534,955 | B2 | 5/2009 | Adams | |
| 7,659,467 | B2 | 2/2010 | Adams | |
| 7,678,982 | B2 | 3/2010 | Adams | |
| 7,692,079 | B2 * | 4/2010 | Lyles | 84/312 R |
| 7,692,085 | B2 | 4/2010 | Adams | |
| 7,786,373 | B2 | 8/2010 | Adams | |
| 7,842,869 | B2 | 11/2010 | Adams | |
| 7,855,330 | B2 * | 12/2010 | Lyles et al. | 84/297 R |
| 7,858,865 | B2 * | 12/2010 | D'Arco | 84/454 |
| 8,022,285 | B2 * | 9/2011 | Zhang | 84/455 |
| 8,110,733 | B2 * | 2/2012 | D'Arco | 84/454 |
| 2003/0183062 | A1 * | 10/2003 | Schryer | 84/313 |
| 2008/0105107 | A1 | 5/2008 | Adams | |
| 2008/0276787 | A1 * | 11/2008 | Adams | 84/304 |

OTHER PUBLICATIONS

"Homemade Guitar Hero," Popular Science, Apr. 2009, Bonnier Corp., Winter Park, FL, USA. Inventor's own work cited for 102(g) purposes.

* cited by examiner

*Primary Examiner* — Marlo Fletcher
(74) *Attorney, Agent, or Firm* — Boyle Fredrickson, S.C.

(57) ABSTRACT

A guitar is played during performance by rapid change in the tension of its strings. In one embodiment, rapid, accurate, and repeatable tuning is obtained by a two-step process of adjusting the tension of the string to a stored value which may be then be corrected according to the pitch of the string obtained at later various times during the performance.

12 Claims, 8 Drawing Sheets

GUITAR WITH HIGH SPEED, CLOSED-LOOP TENSION CONTROL

CROSS-REFERENCE TO RELATED APPLICATIONS

This application claims the benefit of U.S. Provisional Patent Application Ser. No. 61/253,268 filed Oct. 20, 2009 and titled "Guitar With High Speed Closed Loop Tension Control", the disclosure of which is expressly incorporated herein.

BACKGROUND OF THE INVENTION

The present invention relates generally to guitars and in particular to a guitar that can be played without fretting through the use of servo controlled string tension.

The guitar is an extremely versatile musical instrument, in part because it offers the performer an ability to independently and flexibly control four musical parameters of: note pitch, note volume, note timing, and note overtones (timbre) in a melodic polyphony. In contrast, instruments like the piano, which rival the guitar for popularity, provide a far more constrained control of pitch (only to semitones) and volume, and very little control of note overtones. Skilled guitarists can exploit various modulation and transition effects such as glissando, vibrato, "hammer-on", chiming, pitch bending, and other techniques to offer additional variation to the audio palette provided by the instrument. The introduction of the electric guitar in the 1930s further expanded the variety of sounds that can be produced by this instrument.

Unlike other polyphonic instruments such as the harp and piano, the guitar divides the task of controlling note pitch and the tasks of controlling note volume and timing between the two hands of the performer. The control of note frequency is simplified by the use of a fretboard allowing one-handed selection of multiple string lengths (and hence note pitches) within a given overall tuning of the strings. Yet despite the simplicity of the guitar fretboard, this approach to pitch control of polyphonic notes has some significant disadvantage. First, given a particular string tuning, it can be difficult or impossible to play some chords or change between certain chords smoothly. Second, the raised frets of the fretboard, which simplify the process of changing the string length to obtain a precise pitch, interfere with some modulation and transition effects possible on the guitar, such as glissando or vibrato.

Often it is desired to further modify the sound of the guitar string, for example, using "effects" boxes such as compressors (sustained), clippers (fuzz) and sweeping filters (wah). Desirably these effects may be controlled during guitar playing; however, such control must normally be relegated to the player's foot to the use of a "pedal" making it difficult to achieve precise control and necessarily tying the musician to a fixed location which may not be desirable for stage performance.

SUMMARY OF THE INVENTION

The present invention provides a guitar that can be played by rapid string tension control without the need for fretting or controlling effective string length with a slide or the like. The pitch of each string can be varied by as much as an octave at high speeds.

There are many reasons one would not expect this to work:

First, it is reasonable to expect that the strings would break or have very short life spans when stretched and relaxed over a tension range providing an octave of pitch adjustment. Available string charts provide a relatively narrow tension value for given strings. There is little data on the yield point of musical instrument strings and standard steel wire would not permit the necessary tension range.

Second, one would expect it to be difficult to obtain sufficient motor torque and speed from small and hence affordable and portable electric motors making a system impractical except as a curiosity.

Initial investigation by the inventor further suggested that conventional automatic tuning techniques, that are successful at slow speeds when a single string is plucked, would be unsuccessful at high speeds when multiple strings are plucked during normal guitar playing. Fourier transform and analog and digital filtering techniques for determining pitch impose a fundamental delay between measurement and frequency determination; this delay is necessary to obtain a sufficiently sized sample window to accurately identify the frequency within a wide range. High speed closed loop control can become unstable with even small amounts of sensor lag, suggesting that monitoring the string frequency could not be used for rapid tuning. Further, any delay in note transition (waiting for the pitch measurement) would likely interfere with demands of musical timing. The ability to accurately detect a single string's frequency when multiple strings are playing (possibly at the same frequency) could cause fundamental tuning mistakes if the signals from different strings are confused. Further, if no strings are plucked, a control loop cannot be locked because there is no sensor data resulting either in control instability or inability to change tuning.

The inventor also determined that the tightening of one string affects the tuning of the other strings. Large dynamic tension changes in one string detune the other strings because of flex of the guitar components. The complexity of the problem increases significantly when multiple strings are being retuned at the same time.

Initial designs indicated that the very small movements in the end of the string necessary to change string tension by as little as a semitone make it difficult to hold accurate tunings when the tension is repeatedly changed. The root of this problem may be material properties such as cold flow and thermal expansion, the slip-sticking of the strings on guides and other similar affects. The inventor's early conclusions were that the relationship between a tensioning actuator's position and the pitch of a string would vary significantly and unpredictably over time.

The present inventor has addressed many of these problems by careful analysis of this instrument, experimentation, and innovative use of materials, and novel design elements that overcome or minimize these problems and as will be described in detail below.

In one embodiment of the invention, the invention provides a guitar having a guitar frame and at least one string held in tension by the guitar frame for free vibration of a central portion of the string. A tension sensor measures tension on the string to provide a tension signal independent of vibration of the string and a string vibration sensor measures vibration of the string to provide a vibration signal. A motorized tensioner receives a drive signal and mechanically communicates with one end of the string to apply tension thereto and a closed loop controller receives the tension signal, the vibration signal, and a note pitch signal providing an intended pitch of the string. The closed loop controller provides the drive signal to tension the string to the intended pitch based on both the tension signal and the vibration signal.

It is thus a feature of at least one embodiment of the invention to provide a guitar that may be played using electronic control of string pitch.

The closed loop controller upon receipt of a new note pitch signal may first adjust the string tension signal to match a stored value associated with the intended pitch of the string and second, after the first adjustment, adjust the string tension signal according to a difference between a pitch derived from the vibration signal and the note pitch signal.

It is thus a feature of at least one embodiment of the invention to permit accurate vibration-based tuning during actual playing of the instrument by using a two-step tuning process using measured tension rather than vibration deduced frequency.

The second adjustment may adjust the stored value.

It is thus a feature of at least one embodiment of the invention to permit slow, long-term correction of tension tuning tables through the use of vibration analysis.

The second adjustment may be performed only when the vibration signal indicates a vibration amplitude within a predetermined range greater than zero amplitude.

It is thus a feature of at least one embodiment of the invention to permit opportunistic correction of the tuning while the guitar is being played.

The second adjustment may perform a shift and match operation on the vibration signal to determine a shift value of a best match of a portion of the vibration signal and itself and compares the shift value to a period of the pitch of the note command signal.

It is thus a feature of at least one embodiment of the invention to provide a fast method of determining string pitch suitable for real time guitar pitch control.

The tension sensor may include a spring attached in series with the string to experience the same tension as the string, the spring having a spring constant less than half a spring constant of the string.

It is thus a feature of at least one embodiment of the invention to minimize the effect of dimensional changes in the guitar frame and string length through the use of the series connected spring.

The guitar may further include a spring communicating with the motorized tensioner to apply a predetermined tension to the string adding to the tension provided by the motorized tensioner.

It is thus a feature of at least one embodiment of the invention to minimize the necessary weight and power requirements for tuning the guitar permitting it to be tuned with light weight actuators.

The motorized tensioner may be driven by a permanent magnet DC motor and the closed loop controller provides a drive signal sized to vary the tension on the string to change the pitch of the string at a rate of no less than 12 percent per second over a range of at least 50 percent. Alternatively or in addition, the motorized tensioner may receive the drive signal to vary the tension of the string over a tension range of at least 100 percent. Alternatively or in addition, the motorized tensioner may be adapted to receiving the drive signal to vary the tension of the string at a rate of at least 5 semitones per second.

It is thus a feature of at least one embodiment of the invention to permit tuning speeds and ranges necessary for the performance of musical compositions solely through tension changes, believed not to previously have been understood to be possible.

The motorized tensioner is driven by a permanent magnet DC motor that operates at less than 20 W average power or less than 0.1 horsepower.

It is thus a feature of at least one embodiment of the invention to provide a low-power actuator system suitable for operation on a portable electronic instrument.

The guitar may include multiple strings with corresponding tension sensors, string vibration sensors and motorized tensioners and a closed loop controller that simultaneously changes tension in multiple strings.

It is thus a feature of at least one embodiment of the invention to permit rapid and novel chord changes in which strings are independently retuned without concern for possible finger positions on frets.

Each of the strings provides a fundamental frequency of free vibration having an anti-nodal point and the anti-nodal points are not aligned along a perpendicular to an extent of the strings.

It is thus a feature of at least one embodiment of the invention to permit radically different vibration string lengths to allow both base and standard tunings on a single instrument unconstrained by the need for common fret positions.

The motorized tensioner may include an electric motor communicating with the string via a flexible cord attached to the string at one end wrapped around a capstan rotated by the electric motor to maintain frictional contact with the flexible cord as a function of string tension.

It is thus a feature of at least one embodiment of the invention to provide a simple capstan drive that automatically releases when a string breaks.

Alternatively, the motorized tensioner includes an electric motor providing a crank arm attached to a lever communicating with the string to apply varying tension to the string as a function of lever position.

It is thus a feature of at least one embodiment of the invention to provide a compact tuning mechanism that provides limited strain tensioning range in the event of control loop failure.

These particular objects and advantages may apply to only some embodiments falling within the claims, and thus do not define the scope of the invention.

DETAILED DESCRIPTION OF THE PREFERRED EMBODIMENT

First Embodiment

Figure 1:
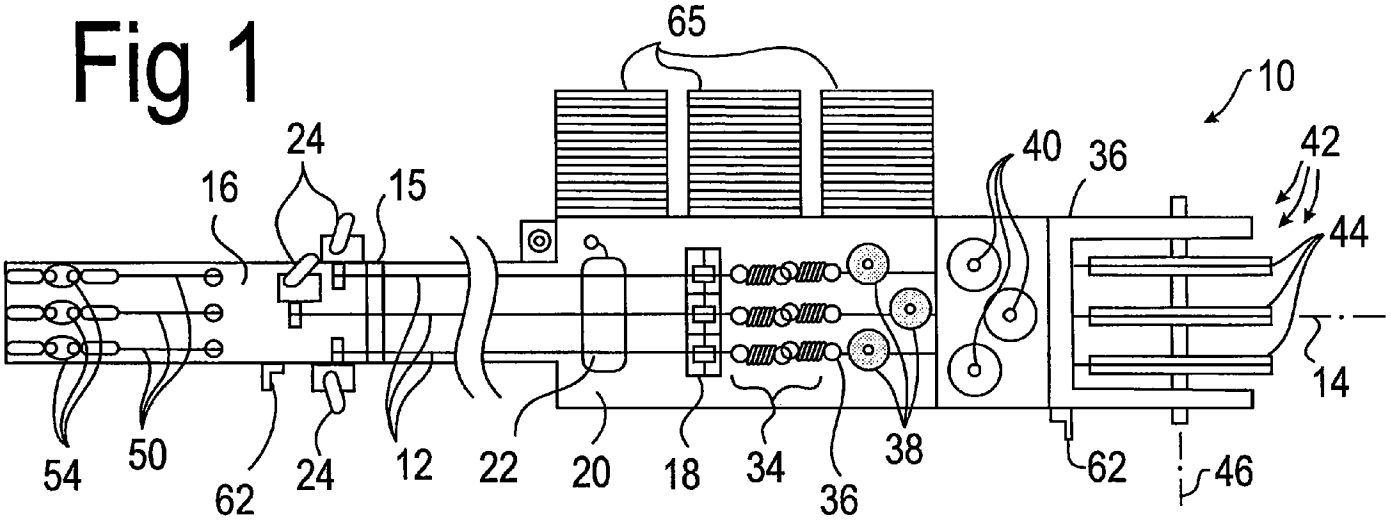
FIG. 1 is a fragmentary, top plan view of an electric guitar constructed according to the present invention, showing the use of permanent magnet synchronous motors driven by onboard, air-cooled amplifiers to dynamically control the tension of individual strings as measured by displacement sensors sensing a distention of function-spring assemblies and further showing the use of negative force compensator springs in opposition to the strings.

Referring now to FIG. 1, a guitar 10 according to the present invention may provide a set of strings 12 extending along a guitar axis 14 between a nut 15 on the neck 16 of the guitar 10 and a floating bridge 18 on body 20 of the guitar 10.

Between the nut 15 and the bridge 18, the strings 12 pass over a guitar pick-up 22 of conventional design having a grounded metallic Faraday shield to resist electronic interference possible from brush DC motors used in the invention and as will be described.

On the far side of the nut 15 from the body 20, the strings are received by standard tuners 24 of a type understood in the art for controlling tension of the springs by turning a thumbscrew.

Figure 6:
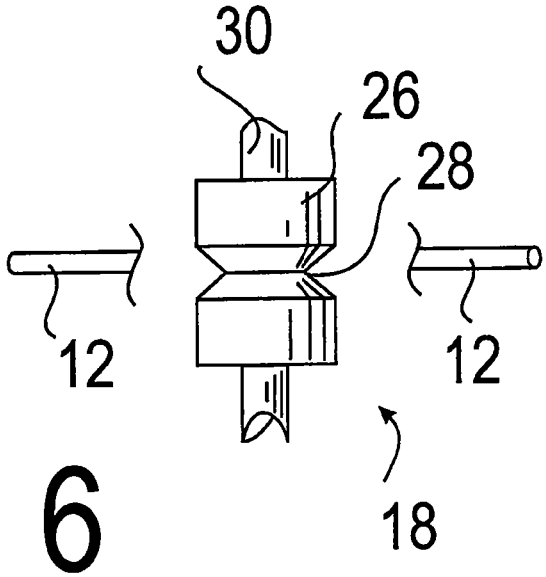
FIG. 6 is a top view of a floating bridge bearing allowing movement of the strings during high range dynamic tension control.

In the present invention, the floating bridge 18 allows for a sliding of the strings therethrough necessary because of their natural elasticity under high dynamic tension. Referring momentarily to FIG. 6, the bridge 18 provides a set of wheels 26 each having a circumferential groove 28 for receiving one string 12 therein. The wheels 26 are free to slide along an axle 30 perpendicular to the extent of the strings to automatically align with the strings 12, and the wheels 26 are free to rotate on that axle 30 to reduce sliding resistance between the strings 12 and the wheels 26. An alternative design may use an ungrooved wheel with a slotted guide plate on the side of the wheel opposite the vibrating string.

The present inventor has determined that despite the contact between the wheels 26 and the strings 12 offering only a sliding termination point, this coupling is sufficient to create the necessary boundary condition for a standing wave on the string to create a high quality factor (Q) resonant structure. In this regard, it appears only to be necessary that the mass of the wheels 26 joined with the elastic coupling of the string 12 have a natural resonant frequency well below the audio frequencies of the string 12 and that a fixed coupling of the strings to the guitar frame is not required. The floating bridge 18 may optionally be replaced with a low friction surface allowing sliding of the strings over the bridge.

The strings 12 pass over the floating bridge 18 away from the nut 15 to attach to an upper end of corresponding function-spring assemblies 34 as will be described in more detail below.

The lower ends of the function-spring assemblies 34 are attached to 200-pound test Dacron tension cord 36 which in turn wraps about sensor drums 38. The tension cord 36 may be fixed to one point on the circumference of the sensor drum 38, centered in the single turn, to prevent slippage. As will be described, the sensor drums 38 may be attached to rotary potentiometers. In an alternative embodiment, the rotary potentiometers may be substituted with slide potentiometers.

A free end of the tension cords 36 proceeds, after a single turn around the sensor drums 38, to a single turn around a capstan drive formed by a shaft 72 of the electric motor 40 oriented across and perpendicular to the path of the tension cord 36. The free end of the tension cord 36 from the shaft 72 is then attached to the periphery of a cosine wheel 44 turning about an axis 46 perpendicular to the guitar axis 14 and forming part of a compensator spring 42 to be described in more detail below.

In one embodiment, the motors 40 may be relatively small DC synchronous motors operating at less than 20 W peak power, for example part number 2342L012CR M124-202 manufactured by Faulhaber Motorn of Switzerland, and are coupled to a planetary gearhead 41 providing approximately a 64:1 speed reduction.

Figure 2:
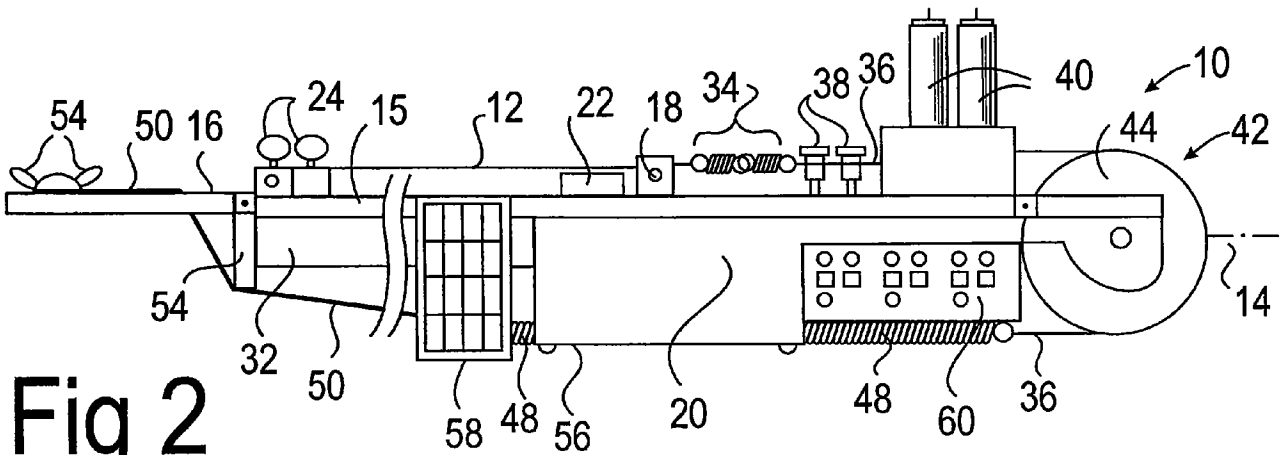
FIG. 2 is a side elevational view of the guitar FIG. 1.

Referring now also to FIG. 2, the neck 16 and body 20 are joined by means of a truss tube 32, being in one embodiment a square tube with a 1 inch square cross-section of fourteen-gauge steel. The truss tube 32 is substantially 36 inches long and extends from beyond the nut 15 to beyond the electric motors 40 to provide a stiff support for a critical dimension between the nut 15 and sensors drums 38. Stiffness of this dimension is important in dynamic string tension control to reduce pitch crosstalk where the tuning of one string affects the tuning of adjacent strings. In contrast, a conventional guitar with static string tensions permits substantially greater flex. In addition, the inventor has determined that suitable stiffness can be obtained such that accurate pitch control may be effected simply through a closed loop positioner without the need to monitor pitch at least for the initial note transitions.

The tension cord 36 proceeds around the cosine wheel 44 to the rear of the guitar 10 where it is attached to one end of a tension offset spring 48. Generally the tension offset spring 48 has a desirably low spring constant k to provide an essentially constant force on the cosine wheel 44 with motion of the cosine wheel 44. In one embodiment, the tension offset spring 48 is a helical extension spring approximately 15 inches long with an outside diameter of 0.4 inches, 0.060 inch diameter wire and a spring constant k of approximately 1.17 pounds per inch. While the use of a cosine wheel 44 allows faster tuning with lower power motors, the cosine wheel may be eliminated with higher power motors or an acceptance of lower tuning transitions.

The free end of the tension offset spring 48 is attached to a tie-off cord 50. The tie-off cord 50 proceeds behind the neck 16 past the nut 15 to a standoff 52 extending rearward from the neck 16 to hold the tension offset spring 48 away from the truss tube 32. The tie-off cord 50 passes under the standoff 52 and then passes upward through a hole in the neck beyond the tuners 24 to be tied off on a cleat 54. A similar structure is provided for each of the strings 12.

Referring to FIGS. 1 and 2, guitar strap cleats 62 may be placed on the side of the neck 16 and body 20 (an upper side during performance) allowing the attachment of a guitar strap (not shown) to support the weight of the guitar 10. Heatsinks 65 having convection cooling fins attached to DC coupled 20 W class B amplifiers (the latter not visible) are attached on the lower edge of the body 20 to improve mechanical stability of the guitar 10 and remove this source of heat from the performer.

Referring still to FIG. 2, the body 20 of the guitar 10 extends rearward to provide for a support surface 56 allowing the guitar to be set down, strings upward, upon a table. A keyboard 58, for example a USB computer keyboard number pad, is attached to a side of the neck 16 for ready access by the performer. A control board 60 is exposed upward through the side of the body 20 allowing adjustment of the control parameters during an initial commissioning of the guitar 10 using trim potentiometers which, for example, adjust the loop gain of the feedback loop.

Figure 3:
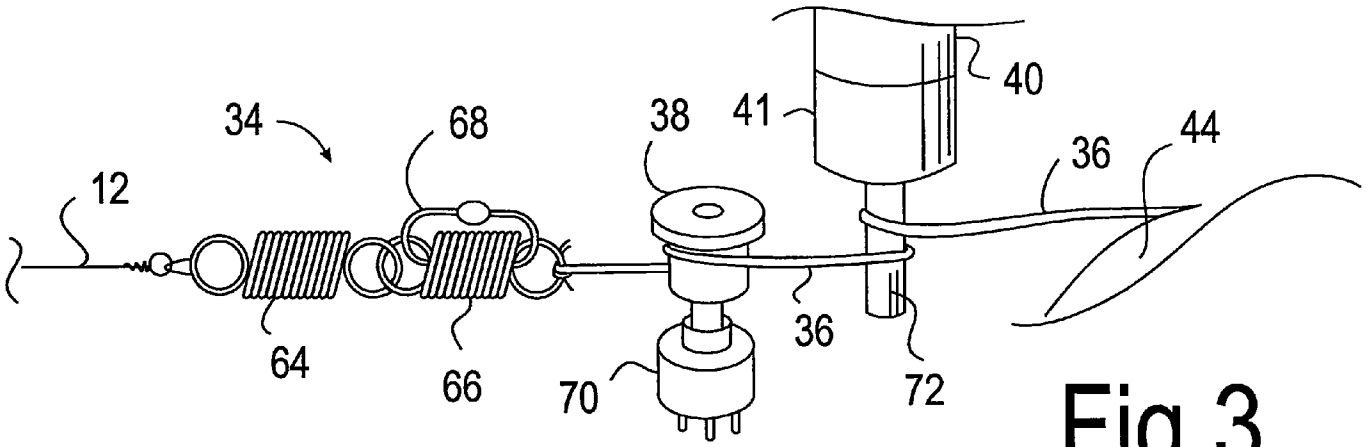
FIG. 3 is a detailed, fragmentary, perspective view of one motor and a corresponding displacement sensor and function-spring for one string of the guitar.

Referring now to FIG. 3, as noted above, each string 12 is attached to a function-spring assembly which, in one embodiment, is comprised of two helical extension springs 64 and 66 connected in series. Helical extension spring 66 is limited in its extension by a nylon binding strap 68 whose purpose is to provide a nonlinear spring constant as will be described below. The tension cord 36, attached to the lower end of the function-spring assembly 34 and wrapping around sensor drum 38, turns a displacement sensor 70 (a 100*k* linear potentiometer) as the function-spring assembly 34 is stretched, allowing measurement of the amount of distention of the function-spring assembly 34. It will be understood that the function-spring assemblies 34 convert displacement of the tension cord 36 into string tension measurable by the displacement sensor 70 as a changing voltage when the potentiometer is used as a voltage divider. Other sensors including optical resolvers, LVDTs, strain gauges, and the like may be used.

Generally the spring constants of springs 64 and 66 are much lower than that of the neck 16 and of the string 12, allowing the latter to be neglected; however, incidental stretch of the string 12 under tension is readily accommodated by the tuning process of the guitar 10 and, unlike flexure in the neck 16, does not affect the tuning of adjacent strings 12. Preferably the spring constants of springs 64 and 66 in series are less than half that of the neck and a string or either individually. In this way, the springs 64 and 66 act like tuning stability springs such that minor dimensional changes, caused for example by thermal expansion of the strings, relaxation or bending of the neck or other guitar materials, can be reduced in effect on the pitch. Generally the position feedback will be that of a spring system including springs 64 and 66 as well as distributed spring effects of the string and guitar neck; however, again the low spring constant of springs 66 and 64 relative to these other effects minimizes the influence of these other effects.

Figure 7:
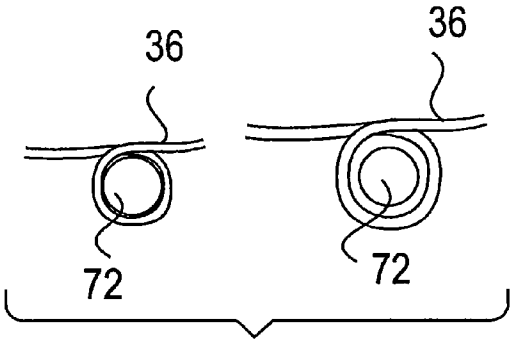
FIG. 7 is a top plan cross-section of the shaft of the electric motor showing the implementation of a capstan drive that limits spooling upon a string break.
Figure 8:
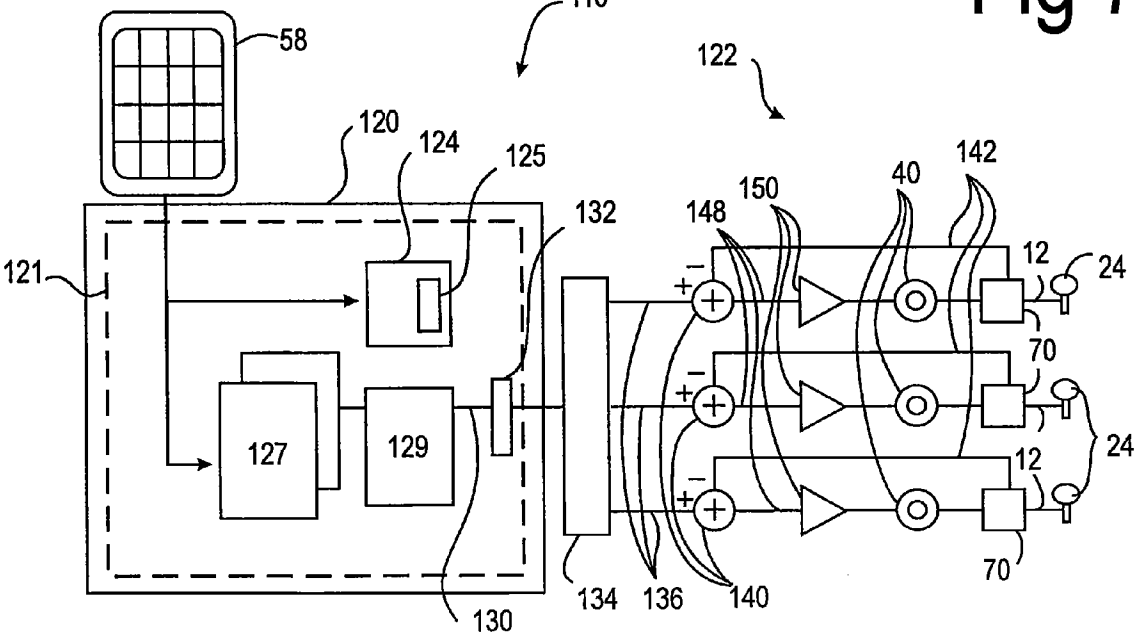
FIG. 8 is an electrical block diagram of the control system of the guitar of FIG. 1 showing an electric keyboard providing signals mapped by a computer to string tension values used to provide command signals to independent closed loop tension control circuits for each string.

Referring momentarily to FIGS. 3 and 7, as described above, after the tension cord 36 leaves the sensor drum 38, the tension cord 36 wraps about a shaft 72 of the electric motor 40 in a capstan configuration. Ideally the shaft 72 may be coated with a high friction material, for example heat shrink polyolefin, placed over a knurled brass sleeve epoxied to the steel motor shaft 72 to provide a capstan diameter of approximately ¼". When the string 12 is in tension, the tension cord 36, as shown in the leftmost illustration, achieves a high friction contact with the shaft 72 caused by an increased cord-to-shaft normal force. This tension is maintained only so long as the string 12 is intact. If the string 12 breaks, as can occur in performance, the wrapping of the tension cord 36 about the shaft 72 loosens, reducing its frictional contact and lessening the chance that the shaft 72, spinning rapidly as closed loop control is lost, spools the tension cord 36.

Figure 4:
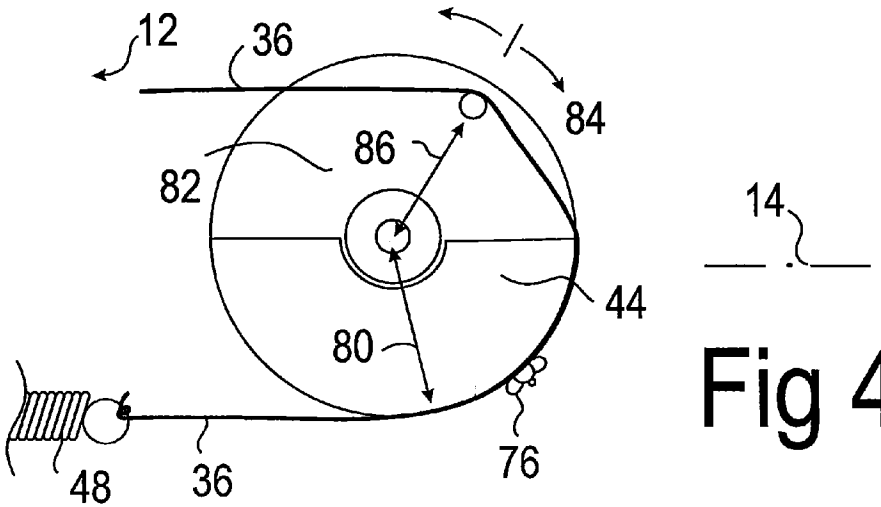
FIG. 4 is a side elevational view of a cosine wheel used in the negative force compensator spring showing critical dimensions thereof.

Referring now to FIGS. 3 and 4, following the capstan drive formed by the shaft 72, as described above, the tension cord 36 is received by the cosine wheel 44. The cosine wheel 44 provides a negative (rightward) force along tension cord 36 counteracting the positive (leftward) force of the string 12 under tension and thus reduces the magnitude of the force felt by the shaft 72 (albeit not the force range as it serves only as an offset). This negative force can nevertheless bring the peak forces down to a point suitable for low stall torque motors 40.

Figure 13:
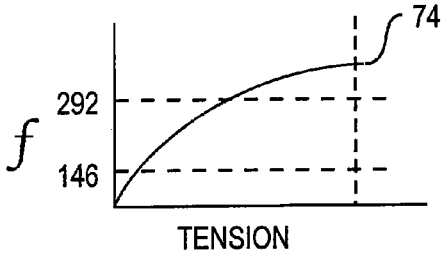
FIG. 13 is a plot of tension versus frequency for a typical string over one octave showing the disproportionate tension range required for a one octave transition such as makes implementation of dynamic tension control problematic.

Further control of the peak forces is desirable because of the high tension range necessary to achieve acceptable tuning compliance. Referring momentarily to FIG. 13, generally frequency of a string will be related to its tension according to the following formula:

$$T = UW\frac{(2LF)^2}{K} \tag{1}$$

where T is tension in pounds force,

UW is unit weight of the string in pounds per linear inch (about 0.0005671 for 0.016 inch diameter steel wire used for strings 12), L is the length of the string from nut to bridge (about 19 inches in this embodiment), F is the frequency in Hertz (a range of approximately 140.8 to 293.6 in this embodiment), and K is a conversion constant equal to 386.4.

As can be seen from equation (1), tension must increase roughly with the square of frequency, requiring a large tension excursion for a relatively smaller frequency excursion. This nonlinearity is compounded by the fact that perceived pitch is a logarithmic function of frequency.

As a practical matter, the achievable range of tension is limited. The lower limit of tension rests on the need for sufficient stiffness of the string 12 for playing and for providing a high Q resonance providing sufficient "sustain" to the notes. The upper limit of tension is the yield point of the material of the string 12 when plucked. The yield point 74 of music wire is largely undocumented by the manufacturers of guitar strings and standard yield strengths of steel suggests that the present instrument could not be constructed without permanent deformation of the strings 12. There appear to be no studies indicating the incremental tension of a plucked string, and the present inventor has not determined how this incremental tension may be reduced by the function-spring assemblies 34.

Nevertheless, the present inventor has determined by experimentation that a 0.016 inch OD guitar string of nickel plated round wire from J D'Addario & Co., Inc. of Farmingdale, N.Y. can be acceptably operated at a tension range from 146 Hz (d) to 292 Hz (octave above d) without reaching a yield point 74. The tension necessary to produce this pitch range is about 2.5 pounds to 11.5 pounds plus the incremental tension caused by plucking.

Figure 5:
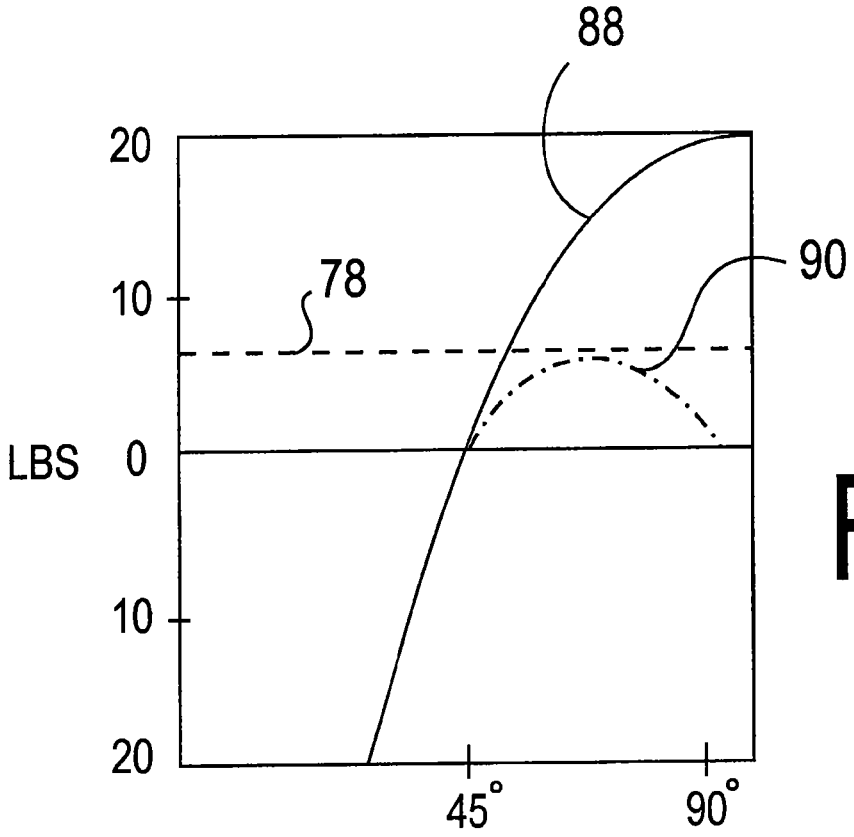
FIG. 5 is a graph of torque versus angle of the cosine wheel of FIG. 4 showing the net force on a cord attached to the cosine wheel and thus the force that must be overcome by the electric motor at various string tensions.

Referring now to FIGS. 4 and 5, rapid pitch change with a small DC motor over this tension range is enhanced by the cosine wheel 44 forming part of a compensator spring 42 that not only provides a negative offsetting force but a negative slope offsetting force to reduce the tension excursion experienced by the motor 40. The tension cord 36 wraps partially about the cosine wheel 44 and is attached to its outer periphery by means of a wingnut 76 and an associated washer to cause rotation of the cosine wheel 44 with movement of the tension cord 36. The cosine wheel 44 applies a negative force to the upper portion of the tension cord 36 as a result of the force of the tension offset spring 48, attached to a lower portion of the tension cord 36, operating on a constant radius 80 portion of the cosine wheel 44, radius 80 being approximately 3.75 inches in one embodiment. The force provided by the tension offset spring 48 is substantially constant as a result of its low spring constant with respect to movement of the cosine wheel 44.

The upper portion of the tension cord 36 leading from the function-spring assemblies 34 does not attach to a constant radius portion of the cosine wheel 44 but instead to a fixed peg 84 positioned so that the tension cord 36 is received at an angle of 45° with respect to the radius line 86 of the peg 84 at the midrange of tension adjustment. The peg 84 is centered within a deep groove 82 in the cosine wheel 44 so that the angle between the radius line 86 and the tension cord 36 changes directly with rotation of the cosine wheel 44, increasing as the cosine wheel rotates in a counterclockwise direction as depicted. It will be understood that this arrangement generally provides increased negative force on the function-spring assemblies 34 as the function-spring assemblies 34 are distended such as increases their positive force, according to principles of vector decomposition in which clockwise rotation of the cosine wheel 44 provides increased mechanical advantage. The cosine wheel 44 thus effectively provides, over a short range, a spring constant having a negative slope, where the spring force increases as the upper tension cord 36 moves in the direction of pull of the cosine wheel 44 under the influence of tension offset spring 48, (exactly the opposite of a standard spring which provides a spring constant with positive slope).

Referring now to FIG. 5, using this arrangement, the force 88 of tension in the upper tension cord 36 leading from the function-spring assemblies 34 and string 12 (neglecting the influence of the sensor drum 38 and capstan drive of shaft 72) as a function of the angle of the cosine wheel 44 (defined as 90° minus the angle between the radius line 86 and the tension cord 36) rises rapidly as the string 12 is tensioned. In contrast, however, the net force 90 on the upper tension cord 36, reflecting the net force felt by the motor 40, is bounded at a relatively low value (less than ten pounds) over the required tension range. Intuitively, this is because of the relatively constant torque exerted by the tension offset spring 48 on the cosine wheel 44 and the increased mechanical advantage of the cosine wheel 44 in pulling the upper tension cord 36 leading from the function-spring assemblies 34 as the angle between the radius line 86 and tension cord 36 decreases and the cosine wheel 44 rotates clockwise. The benefit of the compensator spring 42 is the ability to use a lower powered motor 40 or to provide more rapid pitch transition for a given power of motor 40.

Referring again to FIG. 13, it can be seen that changes in tension for low frequencies have a far more pronounced effect on the string pitch than changes in tension at high frequencies. This is evident in the slope of the line plotting frequency or pitch versus tension in FIG. 13.

Figure 12:
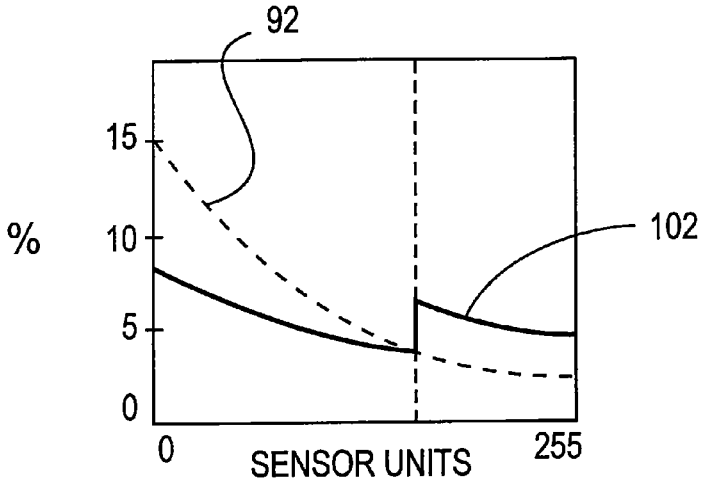
FIG. 12 is a graph showing quantization error of an 8-bit sensor with a standard linear spring function and with the piecewise nonlinear function implemented by the function-spring assemblies.

While potentiometers, such as sensors 70, are often described as having "infinite" resolution, actual resolution will be practically limited by noise, resistor surface roughness, and other mechanical considerations including mechanical play and the like. Generally actual resolution data is not provided for standard volume control type potentiometers. Nevertheless, the present inventor has determined experimentally that a potentiometer supports a resolution of at least one part in 255 (eight bits) for a working range of about 50°. Referring to FIG. 12, assuming the potentiometer displacement sensor 70 provides for 256 discrete sensing levels (sensor increments) over a full octave in pitch, a quantization error 92 (expressed as a note percentage per sensor increment) varies substantially as a result of the nonlinear function relating tension to pitch. It can be seen that a quantization error of nearly 15% in pitch occurs at lower frequencies.

Figure 11:
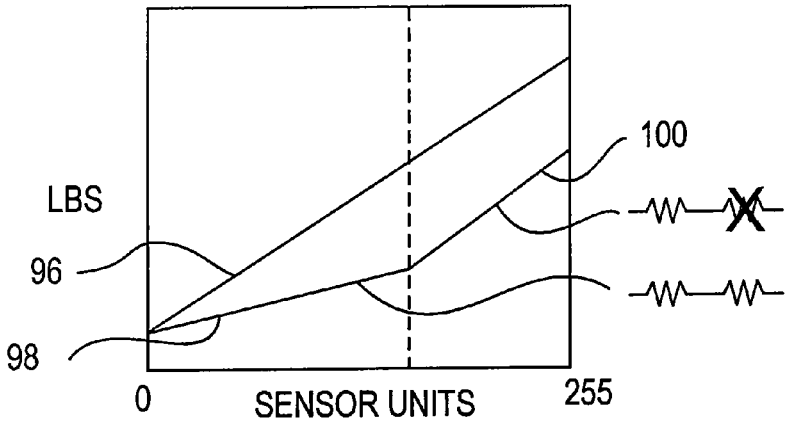
FIG. 11 is a graph showing a piecewise nonlinear function implemented by the function-spring assemblies.

The present invention addresses this problem of quantization error at low frequencies through the use of a nonlinear spring function realized by function-spring assemblies 34. Referring to FIGS. 3 and 11, spring 64 alone would provide a linear spring function 96. When added in series with a nearly identical spring 66, the spring function 96 is halved as shown by spring function section 98 operating at low tensions. This lower spring function of section 98 provides for relatively greater movement of the sensor drums 38 for increments in tension, increasing the effective resolution of the sensors 70. As string tension is increased, spring 66 is prevented from further distention by binding strap 68 and at this point, as indicated by function section 100, the combined spring function returns to the slope provided by spring 64 alone. This preserves the low quantization errors found at higher string tensions and prevents over-travel of the displacement sensor 70. The result of the construction of the function-spring assemblies 34 is a piecewise approximation of a parabolic spring function approximating the relationship between tension and pitch providing, in two segments, two different spring constants, a lower one for lower notes and a higher one for higher notes. The result can be seen in FIG. 12 in bounded quantization error curve 102 provided by this arrangement.

Figure 15:
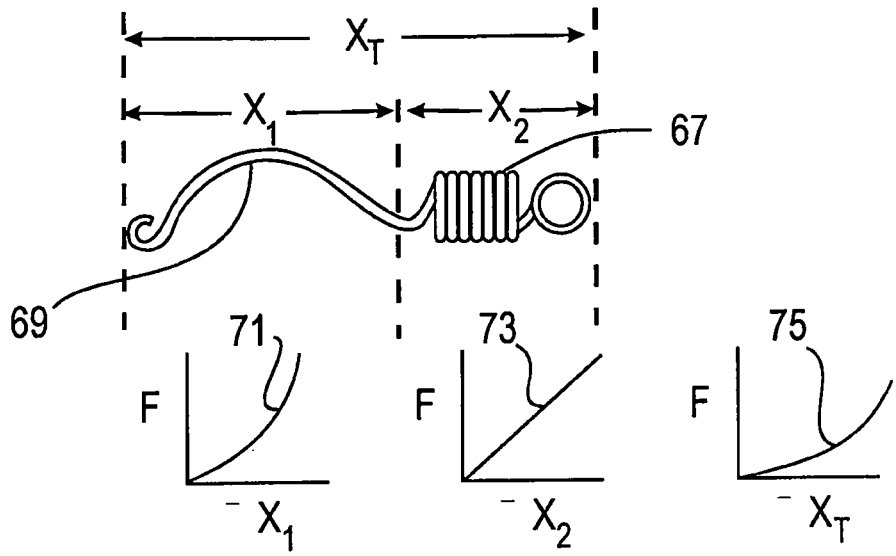
FIG. 15 shows an alternative design for a nonlinear spring providing a continuous spring function.

Referring momentarily to FIG. 15, a continuously variable nonlinear spring may be constructed by using a standard helical section 67 in series with an arcuate section 69 either as an integral wire form as shown or as to link to spring elements. In this latter case the arcuate section 69 may be a leaf spring. The arcuate section 69 provides a nonlinear spring function 71 that approaches infinity as the arc of the arcuate section 69 straightens out. By combining this with a linear or Hooke's law spring function 73 of the helical springs section 67, a desired nonlinear spring function 75 may be obtained.

Linear slide potentiometers can provide higher resolutions of at least one part in 512.

Figure 14:
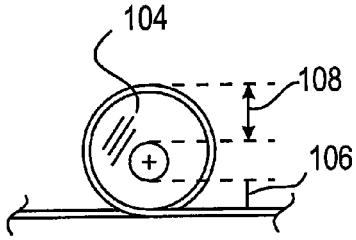
FIG. 14 shows an eccentric sensor pulley that can provide reduced note quantization error as an alternative to the function-spring assemblies.

Referring now to FIG. 14, an alternative approach, albeit one that has the disadvantage of different moment arms on the displacement sensor 70, employs an eccentric sensor pulley 104 in place of concentric sensor drums 38. The pulley 104 presents a smaller radius 106 for lower notes and a higher radius 108 for higher notes providing a similar effect on sensor pitch resolution.

Referring now to FIG. 6, in one embodiment, the present invention provides a control system 110 receiving signals from the displacement sensor 70 and the keyboard 58 and providing signals to the motors 40 for operation of the guitar 10. The control system 110 includes a processor 120 executing a stored program 121 providing for note selection and other effects. The control system 110 also includes analog circuitry 122 providing for high-speed closed loop tension control.

Figure 9:
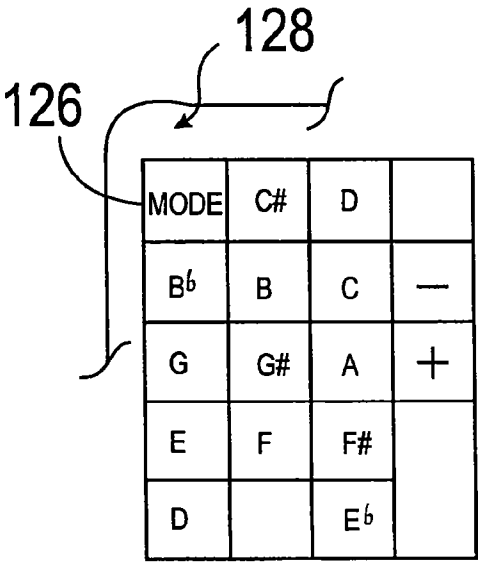
FIG. 9 is a functional assignment diagram showing the functional assignment of the keys of the keyboard during tuning of the guitar.

The keyboard 58 may provide key-press signals to the processor 120 that allow the user to operate the guitar 10 selectively in one of three modes: a tuning mode, a chord playing mode, and a mode selection mode. Referring also to FIG. 9, in the tuning mode, a tuning program 124 is activated by a mode key 126 on the keyboard associated with an LED 128 providing a mode status. In this tuning mode, the keys of the keyboard 58 are associated with different notes of the octave for a selected string (to be described below) and "plus" and "minus" keys are used to tune up or down from a default tuning value held in a pitch-to-tension conversion lookup table 129 whose values are derived mathematically using the formula provided above. These calculated tensions in the pitch-to-tension conversion lookup table 129 are adjusted by values held in a tuning table 125 accumulating the signals from the "plus" and "minus" keys pressed during the tuning process for each of the strings 12 and each of the notes of the octave. The values in the tuning table 125 provide an addend or subtrahend that is combined with the value in the table 129 during performance. As the tuning is performed, the then current tension value 130 (being the combination of the data in the pitch-to-tension conversion lookup table 129 and the tuning table 125) is provided to a network interface 132 leading to an I/O board 134 providing for a pitch command voltage 136 for the particular string 12 allowing it to be played during the tuning process. Individual strings 12 may be played in this mode.

Figure 10A:
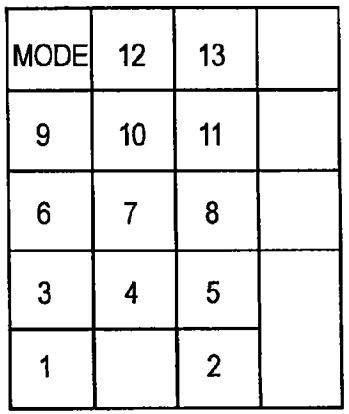
FIGS. 10*a* and 10*b* are figures similar to that of FIG. 9 showing the functional assignment of the keys of the keyboard during playing of the guitar and during a mode selection.
Figure 10B:
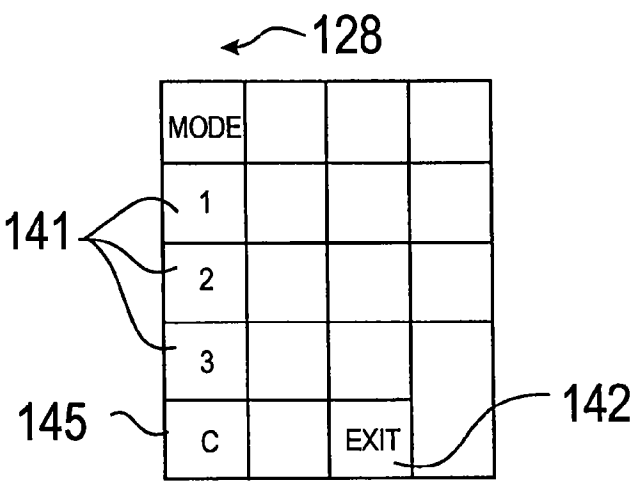

Referring to FIG. 10*b*, in the mode selection mode, the LED 128 is not illuminated and the keyboard provides for string selection keys 141, an escape key 143 terminating the program 121, and a chord selection key 145 allowing chord mode playing. Using this mode, a particular string for tuning (or playing) may be selected by pressing a string selection key 141 associated with that string.

Alternatively, the chord mode may be selected by pressing the chord selection key 145. This selection shifts the program to the chord mode where the keys of the keyboard 59 adopt an arbitrary meaning as indicated by FIG. 10*a* where particular numbers may map to any designated chord. For example, in a circle of fifths, major chords may be mapped to strings 1 through 13. Alternatively an arbitrary pattern or palette of harmonic relationships may be generated, for example "blues chords" or other standard chord progressions as well as scale progressions. These palettes are stored in a play mapper table 127 and multiple play mapper tables 127 maybe stored and switched between during playing of the guitar 10. The values of the mapper tables 127 map individual keys to selected pitches on each of the strings 12. These pitches are received by the look up table 129 and the values of the tuning table 125 are added to the pitches as before to produce tension values 130 (carrying information for all strings) for tuning of the strings 12 in real time. These values of the tuning table 125 may provide for microtonal intervals, if desired, and arbitrary tunings across the strings.

The command signal is received by I/O board 134 to produce pitch command voltages 136 which are provided to summing junctions 140 (implemented by operational amplifiers) which receive feedback signals 142 from the sensors 70 to produce differences termed the error signals 148. The error signals 148 are amplified by proportional amplifiers 150 whose outputs drive electric motors of 40. In this way, closed loop dynamic tension control may be obtained.

Second Embodiment

In one embodiment, the elements of the processor 120 and the summing junction 140 may be implemented by a microcontroller such as the Arduino Duemilanove, an open source single board computing system described at http://www.arduino.cc. This microcontroller may implement a classic proportional integral control strategy for improved note accuracy and response time of the type well understood in the art, albeit, not for guitar tuning.

The present invention provides tension variation for each of the strings 12 over a full octave with a semitone time constant (the time required to reach 90% of a pitch one semitone away at the highest frequency) of less than one half second and typically less than one quarter of a second. 1/16 second time constant time can be readily obtained with 20 W DC coupled amplifiers according to the present design. The time constant can be readily adjusted either by filtration of the pitch command voltages 136 with a low pass filter or by implementation of a routine in program 121 providing for a ramp output. A long time constant can provide for slide effects and overshoot. A suitable control program 121 can provide for vibrato, microtonal tunings, pitch bends, and the like.

Third Embodiment

Figure 16:
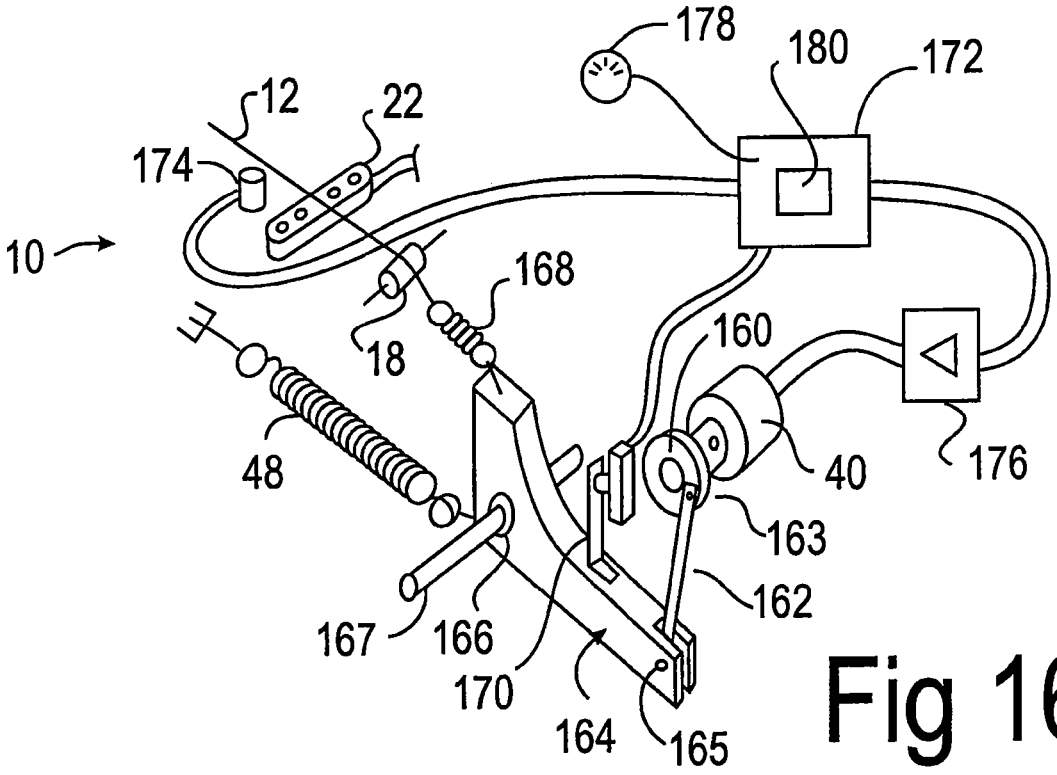
FIG. 16 is a exploded perspective view of an alternative string tensioning system using a crank arm and providing vibration sensing.

Referring now to FIG. 16, in another embodiment, a fractional horsepower DC motor 40 providing less than 20 watts of average power and less than 0.1 horsepower may have its shaft attached to a crank arm 160 in the form of a wheel about an axis defined by the motor shaft. A suitable motor may be the 253500 motor from Jameco Electronics of Belmont, Calif. having nominal operating parameters of 12 volts, 82 milliamps at 60 rpm with the torque of 3200 grams per centimeter using a 90:1 speed reducer.

A crank rod 162 may attach to a pivot point 163 on the periphery of the crank arm 160 at one end and extend downward to a pivot point 165 at the end of a longer leg of an L-lever 164. The L-lever 164 may pivot about an axle 167 perpendicular to a plane of the L, the axle 167 passing through a ball bearing 166 at the 90 degree corner of the L-lever where the longer leg attaches to a shorter leg extending substantially vertically therefrom. An upper end of the shorter leg attaches to one end of a tension converter spring 168 having a spring constant much less than the spring constant of the string 12 and generally less than half of that latter spring constant.

The tension converter spring 168 (operating also as a stability spring) attaches at its other end to the string 12 prior to the string 12 passing over the floating bridge 18 of the type described above. Generally the tension converter spring 168 increases the amount of movement of the L-lever for giving change in tension to provide two beneficial effects. First, it makes a measurement of the change in tension easier because changes in tension result in a larger positional movement of the L-lever 164. Second, it dominates small dimensional changes in the guitar neck and frame and string length, for example, with temperature that would otherwise have a significant effect on the string.

The lower end of the shorter leg of the L-lever is attached to tension offset spring 48 which provides a counter-rotational torque on the L-lever 164 relative to the torque exerted on the L-lever 164 by the tension to string 12 and tension converter spring 168. The attachment point of the tension offset spring 48 to the L-lever 164 is very close to the axle 167 so as to minimize change in length of the tension offset spring 48 with movement of the L-lever 164 providing a more constant force over range of motion of the L-lever 164. A sliding potentiometer sensor 170 may be attached between the guitar frame and an upper surface of the L-lever 164 to measure positional movement of the L-lever 164 and hence change in tension on the string 12.

A microcontroller 172 such as an Arduino microcontroller described above may receive a signal from a string dedicated magnetic pickup 174 sensing vibration in the string 12. This signal may optionally be processed by intervening amplifier and filter stages, the filters effecting a bandpass filter defining a range of fundamental frequencies of the string 12 during a range of tuning. The microcontroller 172 may also receive a sensor signal from the sensor 170, the latter operating as a voltage divider, and may provide signals to a DC amplifier 176 providing power to the motor 40. The controller 172 may also receive a note input signal to an input 178. This note input signal may, for example, be provided by a keyboard or may, for example, be a MIDI signal from a MIDI keyboard or sequencer.

The microcontroller 172 may execute a stored program 180 to provide for closed loop control of the tension of the string according to the note input signal, the signal from the pickup 174, and the signal from the sensor 170.

Figure 17:
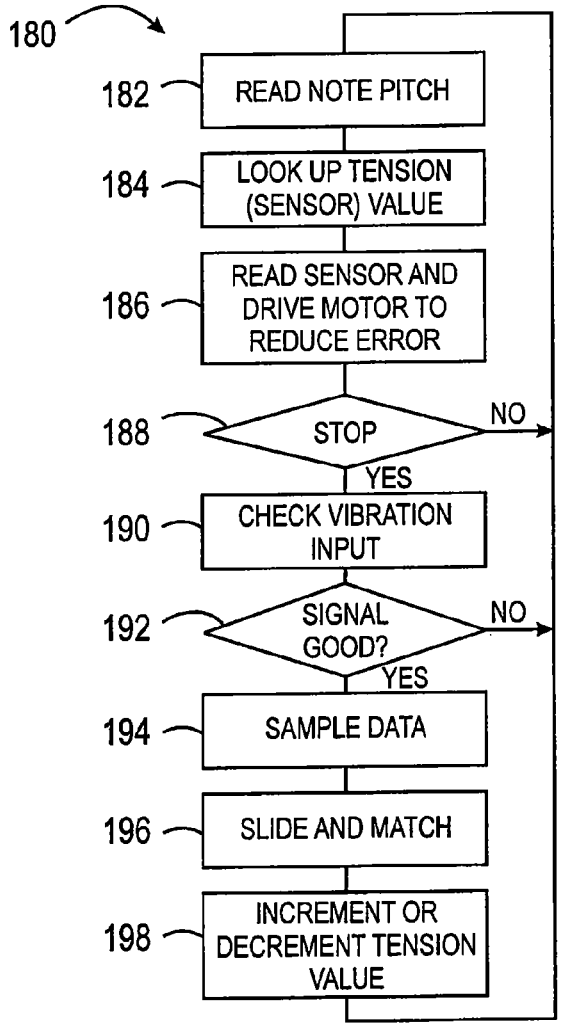
FIG. 17 is a flowchart executed by the controller of FIG. 16 for providing dual tension and vibration-based tuning.

Referring now to FIG. 17, the program 180 may begin as indicated by process block 182 by reading the note pitch signal from input 178. This signal which may, for example, be a note number, may be converted to a pitch range of the string 12, for example, by a modulo division by 12. The converted note number may be applied to a lookup table having a set of programmed tension values each corresponding to a particular value of the sensor signal from sensor 170 per process block 184. The values of this lookup table maybe entered by a manual tuning operation in which the string 12 is tuned to a pitch by up and down commands to the microcontroller 172 by a keypad or the like (not shown in FIG. 16) and a value from the sensor 170 is enrolled in the table. This tension value is then used, as indicated by process block 186, for closed loop feedback control of the motor in which the controller 172 provides a signal to the amplifier 176 to drive the motor 40 to reduce a difference between the tension value from the lookup table and the actual sensor value provided by the sensor 170. This feedback process may use any of a variety of feedback algorithms including PID control algorithms and, in one embodiment, increases the loop gain of the feedback loop as the speed of the motor 40 decreases or if the error between the tension value and the sensor value is below a predetermined threshold.

At process block 188, the program determines whether the motor 40 has stopped and, if so, the signal from the pickup 174 is checked as indicated by process block 190. If this signal strength is suitable for measurement of string frequency as indicated by process block 192 (e.g. within a predetermined range) a rapid series of samples of the signal from the pickup 174 are taken at twice the Nyquist frequency of the anticipated string pitch (for example using an interrupt routine) as indicated by process block 194. This data is analyzed as indicated by process block 196 by sliding a section of the sampled waveform early in the sampled waveform to later positions in the sample waveform to find the best match. This match may be indicated by an autocorrelation value or by an average weighted mean process as described in paper: "YIN, a fundamental frequency estimator for speech and music" by Alain De Cheveigne and Hideki Kawahara: J. Acoust. Soc. Am. 111 (4), April 2002. This technique may be referred to generally as "shift and match" and refers to autocorrelation or average weighted mean or similar techniques.

The result of this slide matching is a lag value indicating the time separation between the match components which can be converted to a frequency (by inversion) and compared to a desired frequency deduced from the input 178 to produce a frequency error value. The difference between these two values provides a frequency error value that is used to slowly increment the lookup tension value of process block 184 per process block 198. In this way, over a period of time the tuning of the guitar is corrected. Nevertheless even when the guitar is not being played it may be rapidly tuned simply by reliance on the sensor 170.

The tension sensor could be a spring and potentiometer as described or a load cell and strain gauge, or any flexing element and a position sensor including, for example, a capacitive sensor or LVDT or the like, or other known force sensors capable of measurement of string tension. It will be understood that a rotary potentiometer may be used attached directly to the motor to provide increased tension resolution at lower notes as would be desirable.

This second embodiment provides for some additional and different features but should otherwise be understood to take advantage of the previous embodiments where not inconsistent with the present description.

While not used in the present embodiment, the invention also contemplates that a hysteresis table may be developed indicating anticipated errors caused by slip sticking of the components. This table determines when the motion of the L-lever 164 stops and records the shortfall or overshoot from its desired position for the particular starting and ending note tensions. This is used to change the target position for the same note transition at a later time. If there is undershoot, for example the target position is increased to an overshoot position with the expectation that the L-lever 164 will then stop at the correct position. A similar technique may be used to correct for pitch cross talk caused by different tensions in the strings, although it is not used in this present embodiment and does not appear to be necessary at the tuning speeds obtained.

Figure 18:
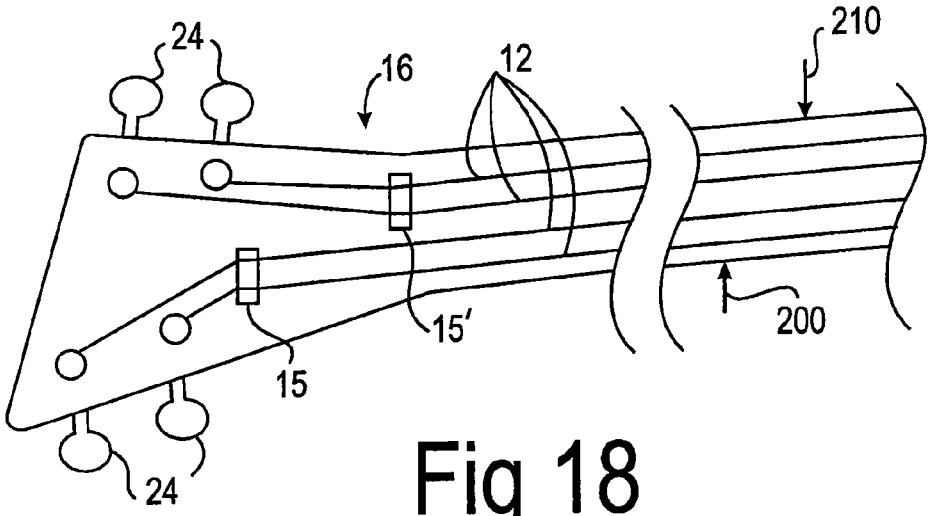
FIG. 18 is a fragmentary detail of a neck of the guitar of the present invention showing the ability to provide for different string lengths that do not have aligned tuning points.

Referring now to FIG. 18, the ability to tune the guitar 10 by means of change of tension of the strings 12 permits the nut 15 to be broken into two parts 15 and 15' to provide different free lengths of the strings 12 permitting, for example, base guitar strings to be mixed with standard guitar strings. This variation in string length will cause the nodal points 200 and 210 for the strings 12 assigned to the different nuts 15 and 15' to not line up upon a perpendicular to the strings 12 such as would create a problem for a fret-based guitar but not for the present invention.

The present inventor has determined that the inherent sliding between notes as the notes are changed is made more attractive by jumping quickly between notes that are close together (e.g., a few semitones) but limiting the speed of transition between notes that are farther apart, for example, by employing a ramped control signal of limited maximum slope. While the present inventor does not wish to be bound by a particular theory, it is believed that this prevents disharmonious overshoot that provides an out of tune twang effect.

In the present invention, an ability to tune rapidly over an octave permits arbitrarily complex chordal structures to be produced and moved among freely. Pitch control without frets gives the performer great freedom with respect to modulation and transition effects such as glissando, vibrato, microtonal tunings, and multi-directional pitch bends. Elimination of frets further permits a single guitar to have strings of multiple lengths and different tuning intervals. By freeing up the user's left hand, for example through the use of a sequencer input, additional control of other tonal qualities by the user's left hand can be obtained.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to "a controller" and "a processor" can be understood to include one or more controllers or processors that can communicate in a stand-alone and/or a distributed environment(s), and can thus be configured to communicate via wired or wireless communications with other processors, where such one or more processor can be configured to operate on one or more processor-controlled devices that can be similar or different devices. Furthermore, references to memory, unless otherwise specified, can include one or more processor-readable and accessible memory elements and/or components that can be internal to the processor-controlled device, external to the processor-controlled device, and can be accessed via a wired or wireless network.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

I claim:

1. A guitar comprising:

a guitar frame;

at least two strings held in tension by the guitar frame for free vibration of a central portion of the string;

at least one string vibration sensor measuring vibration of the strings to provide a vibration signal for each string;

a motorized tensioner associated with each string and receiving a drive signal and mechanically communicating with one end of an associated string to apply tension thereto;

a controller receiving the vibration signals and a note pitch signal associated with each string and providing an intended pitch of the associated string, the controller providing drive signals to each motorized tensioner to tension a string to a pitch based on the vibration signal and the note pitch signal;

further including stability springs communicating with each string so that a force of tension of the string is transferred at least in part to the stability spring, with each such stability spring attached to only one string, the stability springs each having a spring constant less than half a spring constant of an associated string, the stability springs each operating to increase the necessary movement of the motorized tensioner, as applied to an associated string, to effect a given pitch change.

2. The guitar of claim 1 wherein the motorized tensioner is driven by a permanent magnet DC motor and wherein the closed loop controller provides a drive signal sized to vary the tension on the string to change the pitch of the string at a rate of no less than 12 percent per second over a range of at least 50 percent.

3. The guitar of claim 1 wherein the motorized tensioner receives the drive signal to vary the tension of the string over a tension range of at least 100 percent.

4. The guitar of claim 1 further including a keyboard providing at least one note pitch signal, the note pitch signal varying the tension of the string at a rate of at least 5 semitones per second.

5. The guitar of claim 1 wherein the motorized tensioner is driven by a permanent magnet DC motor and wherein the motor operates at less than 20 W average power.

6. The guitar of claim 1 wherein the motorized tensioner is driven by a permanent magnet DC motor and wherein the motor is a fractional horsepower motor of less than 0.1 horsepower.

7. The guitar of claim 1 wherein the motorized tensioner includes an electric motor communicating with the string via a flexible cord attached to the string at one end wrapped around a capstan rotated by the electric motor to maintain frictional contact with the flexible cord as a function of string tension.

8. The guitar of claim 1 wherein the motorized tensioner includes an electric motor providing a crank arm attached to a lever communicating with the string to apply varying tension to the string as a function of lever position.

9. The guitar of claim 1 including multiple strings with corresponding tension sensors, string vibration sensors and motorized tensioners and wherein a closed loop controller simultaneously changes tension in multiple strings.

10. The guitar of claim 9 wherein each of the strings provides a fundamental frequency of free vibration having an anti-nodal point and wherein the anti-nodal points are not aligned along a perpendicular to an extent of the strings.

11. The guitar of claim 1 further including an offset spring communicating with each string and having one end fixedly attached to the guitar frame to bias the string with which it communicates to a predetermined tension absent other forces on the string and substantially independent of tension in any other string.

12. A guitar comprising:

a guitar frame;

at least two strings held in tension by the guitar frame for free vibration of a central portion of the string;

a motorized tensioner associated with each string and receiving a drive signal and mechanically communicating with one end of an associated string to apply tension thereto;

a controller receiving the note pitch signal associated with each string and providing an intended pitch of the associated string, the controller providing drive signals to each motorized tensioner to tension a string to a pitch based on the note pitch signal;

and further including stability springs communicating with each string so that a force of tension of the string is transferred at least in part to the stability spring, with each such stability spring attached to only one string, the stability springs each having a spring constant less than half a spring constant of an associated string, the stability springs each operating to increase the necessary movement of the motorized tensioner, as applied to an associated string, to effect a given pitch change.

* * * * *